US009090111B2

(12) United States Patent
Tsuchiya et al.

(10) Patent No.: US 9,090,111 B2
(45) Date of Patent: Jul. 28, 2015

(54) PRINTER APPARATUS AND PRINTER HEAD

(75) Inventors: Masahiro Tsuchiya, Tokyo (JP); Yukihiro Mori, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 84 days.

(21) Appl. No.: 13/534,225

(22) Filed: Jun. 27, 2012

(65) Prior Publication Data

US 2013/0044178 A1 Feb. 21, 2013

(30) Foreign Application Priority Data

Aug. 18, 2011 (JP) ..... 2011-179178

(51) Int. Cl.

*B41J 2/32* (2006.01)
*B41J 11/00* (2006.01)
*B41J 11/46* (2006.01)

(52) U.S. Cl.

CPC .. *B41J 11/46* (2013.01); *B41J 2/32* (2013.01); *B41J 11/009* (2013.01); *B41J 11/0095* (2013.01); *B65H 2301/544* (2013.01); *B65H 2553/412* (2013.01); *B65H 2553/414* (2013.01); *B65H 2553/416* (2013.01); *B65H 2553/81* (2013.01)

(58) Field of Classification Search

CPC .... B41J 2/32; B41J 11/009; B65H 2301/544; B65H 2553/412; B65H 2553/414; B65H 2553/416; B65H 2553/81
USPC ..... 347/218, 221, 222
See application file for complete search history.

(56) References Cited

U.S. PATENT DOCUMENTS

| | | | | |
|---|---|---|---|---|
| 5,079,565 | A * | 1/1992 | Shimizu et al. | 347/172 |
| 6,017,159 | A | 1/2000 | Tse | |
| 6,232,996 | B1 | 5/2001 | Takahashi et al. | |
| 6,394,676 | B1 * | 5/2002 | Dresher | 400/703 |
| 7,621,247 | B2 | 11/2009 | Iwama et al. | |
| 8,152,393 | B2 | 4/2012 | Tsuchiya et al. | |
| 2004/0145717 | A1 | 7/2004 | Kobayashi | |
| 2006/0022155 | A1 | 2/2006 | Oguri | |
| 2006/0279624 | A1 | 12/2006 | Tsuchiya et al. | |
| 2008/0019749 | A1 * | 1/2008 | Suzuki | 399/389 |
| 2011/0193927 | A1 | 8/2011 | Matsushima et al. | |

FOREIGN PATENT DOCUMENTS

| | | |
|---|---|---|
| CN | 1204985 | 1/1999 |
| CN | 101293429 | 10/2008 |
| EP | 0487313 | 5/1992 |

(Continued)

*Primary Examiner* — Justin Seo
*Assistant Examiner* — Kendrick Liu
(74) *Attorney, Agent, or Firm* — IPUSA, PLLC

(57) ABSTRACT

A disclosed device printer apparatus includes a recording sheet conveying block holding a recording sheet and including a light emitting element, and a first light receiving element; a head block printing characters, graphics or the like on the recording sheet including a second light receiving element positioned to face the light emitting element so as to directly receive the light; and a control circuit connected to the light emitting element, the first light receiving element, and the second light receiving element, wherein the control circuit determines, when the light is detected by the second light receiving element, that the recording sheet does not exist between the light emitting element and the second light receiving element, and when the light is not detected by the second light receiving element and is detected by the first light receiving element, that the recording sheet exists.

7 Claims, 14 Drawing Sheets

(56) References Cited

FOREIGN PATENT DOCUMENTS

| | | | | | |
|---|---|---|---|---|---|
| EP | 0 694 410 | 1/1996 | | | |
| EP | 1738914 | 1/2007 | | | |
| JP | 5-016462 | 1/1993 | | | |
| JP | 05332717 | A | * | 12/1993 | ..... G01B 11/00 |
| JP | 2008-019845 | 1/2008 | | | |

* cited by examiner

PRINTER APPARATUS AND PRINTER HEAD

CROSS-REFERENCE TO RELATED APPLICATIONS

This patent application is based upon and claims the benefit of priority of Japanese Patent Application No. 2011-179178 filed on Aug. 18, 2011 the entire contents of which are incorporated herein by reference.

BACKGROUND OF THE INVENTION

1. Field of the Invention

The present invention generally relates to a printer apparatus and a printer head.

2. Description of the Related Art

For example, a printer issuing a receipt may be widely used for a cash register in a shop, and an Automated Teller Machine (ATM) or a Cash dispenser (CD) in a bank. In issuing the receipt with an exemplary printer, a thermal recording paper may be conveyed as a recording paper and printed by a thermal head at a predetermined position of the thermal recording paper.

In order to print characters or the like on the predetermined position of the recording paper with the printer, it is preferable to accurately determine the positional information of the recording paper. In order for this, the positional information of the recording paper may be detected by a reflecting optical sensor, in which light emitted from a light source onto a recording paper and reflected by the recording paper is detected by a light receiving element such as a photo detector.

There are various recording papers on which characters or the like are printed by a printer apparatus. For example, the recording paper may already have a printed advertisement or may already have an opening portion at a cut line along which the recording paper is to be cut. If the recording paper has an advertisement that has already been printed, the advertisement may have been color-printed. When the recording paper to be further printed, which recording paper already has the color-printed portion, is irradiated by light, light reflected on the color-printed portion and light reflected on a portion other than the color-printed portion have largely different light volumes. Therefore, there may be a case where an accurate position of the recording paper is not detected by a reflecting optical sensor.

In such a printer apparatus, it is preferable to detect the position of the recording paper at a position as close as possible to the thermal head.

[Patent Document 1] Japanese Laid-open Patent Publication No. 2008-19845

SUMMARY OF THE INVENTION

More specifically, the embodiments of the present invention may provide a printer apparatus including a recording sheet conveying block that holds a recording sheet, the recording sheet conveying block including a light emitting element configured to emit light, and a first light receiving element configured to receive the light; a head block that prints characters, graphics or the like on the recording sheet, the head block including a second light receiving element positioned to face the light emitting element so as to be able to directly receive the light; and a control circuit connected to the light emitting element, the first light receiving element, and the second light receiving element, wherein the control circuit determines, when the light is detected by the second light receiving element, that the recording sheet does not exist between the light emitting element and the second light receiving element, and wherein the control circuit determines, when the light is not detected by the second light receiving element and is detected by the first light receiving element, that the recording sheet exists between the light emitting element and the second light receiving element.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 21 of embodiments of the present invention.

Where the same reference symbols are attached to the same parts, repeated description of the parts is omitted.

First Embodiment (Procedure for Detecting Recording Paper)

Figure 1:
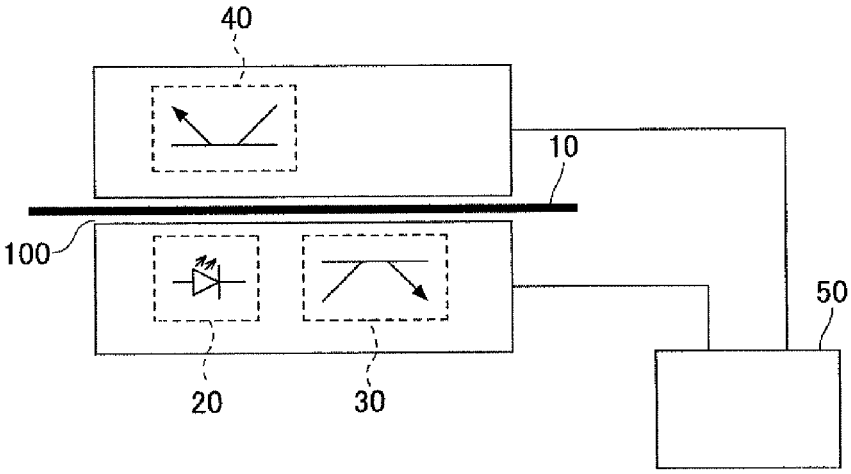
FIG. 1 illustrates a method of detecting a recording paper in a printer apparatus of a first embodiment.

FIG. 1 illustrates a procedure of detecting a recording sheet such as a recording paper in a printer apparatus of a first embodiment. In this embodiment and the other embodiments, the recording paper is exemplified as a recording sheet on which characters, graphics or the like are printed. However, the recording sheet is not limited to the recording paper and may be made of any another material (e.g., plastic) in this embodiment and the other embodiments. Referring to FIG. 1, the printer apparatus of the embodiment includes a light emitting element 20 configured to emit a light onto a recording paper, the light emitting element 20 being provided on one surface side of the recording paper 10 in order to detect information of a position of a recording sheet, a first light receiving element 30 for receiving light which is emitted from a light source onto the recording paper 10 and reflected by the recording paper 10, the first light receiving element 30 being provided on the one surface side of the recording paper 10, and a second light receiving element for receiving light which is emitted from the light emitting element 20, the second light receiving element 40 being provided on the other surface side of the recording paper 10. Within the first embodiment, the light emitting element 20, the first light receiving element 30, and the second light receiving element 40 are connected to a control circuit 50 to thereby detect the position of the recording paper 10. The recording paper 10 is conveyed by a motor or the like based on information of the detected position of the recording paper 10. The light emitting element 20 may include a light emitting diode and so on. The first light receiving element 30 and the second light receiving element 40 may include a phototransistor and so on. The light emitting element 20 and the first light receiving element 30 may be integrally formed. For example, the light emitting element 20 and the first light receiving element 30 may form a reflecting optical sensor.

Within the first embodiment, when the recording paper 10 does not exist between the light emitting element 20 and the second light receiving element 40, light emitted from the light emitting element 20 impinges on the second light receiving element 40, since the emitted light is not shielded by any recording paper. Thus, it is possible to detect that the recording paper 10 does not exist between the light emitting element 20 and the second light receiving element 40. If the light is detected by the second light receiving element 40, information detected by the first light receiving element 30 may be ignored. Said differently, if the light is detected by the second light receiving element 40, it is determined that the recording paper 10 does not exist between the light emitting element 20 and the second light receiving element 40. Therefore, even if light is detected by the first light receiving element 30, it is determined that the light detected by the first light receiving element 30 may be outside light or the like. Therefore, it is possible to further enhance reliability of information indicative of non-existence of the recording paper 10 by ignoring a signal of the light detected by the first light receiving element 30.

When the recording paper 10 exists between the light emitting element 20 and the second light receiving element 40, the light emitted from the light emitting element 20 does not impinge on the second light receiving element 40 since the emitted light is shielded by the recording paper 10. The light is detected by the first light receiving element 30. Therefore, in the above case, information indicative of the detection of the light by the first light receiving element 30 is also considered to thereby further enhance reliability of determining that the recording paper 10 is inserted and exists.

Further, when a black-colored position mark (hereinafter, referred to as a "black mark") used to detect the position of the recording paper 10 is provided on a surface of the recording paper on the side facing the light emitting element 20, reflection of light emitted by the light emitting element 20 is lowered at the black mark to thereby reduce the amount of the light impinging on the first light receiving element 30. Therefore, it is possible to determine the position of the black mark by detecting a point where the amount of the light which impinges on the first light receiving element 30 is lowered.

Further, in a case where an opening portion is formed in the recording paper 10, the light emitted from the light emitting element 20 can impinge on the second light receiving element 40 through the opening portion through the opening portion of the recording paper 10. Therefore, it is possible to detect the existence of the opening portion. Further, it is possible to detect the position of the opening portion formed on the recording paper 10 in a manner similar to the case where the recording paper 10 does not exist. For example, the opening portion may be detected when it is first detected that the recording paper 10 exists between the light emitting element 20 and the second light receiving element 40, and it is detected next that the recording paper 10 does not exist between the light emitting element 20 and the second light receiving element 40. This is because the light emitted from the light emitting element 20 does not impinge on the second light receiving element 40 since the emitted light is shielded by the recording paper 10, and when the recoding paper is conveyed so that the opening portion faces the second light receiving element 40 the light emitted from the light emitting element 20 impinges on the second light receiving element 40.

(Circuit Diagram for Detecting Recording Paper)

Figure 2:
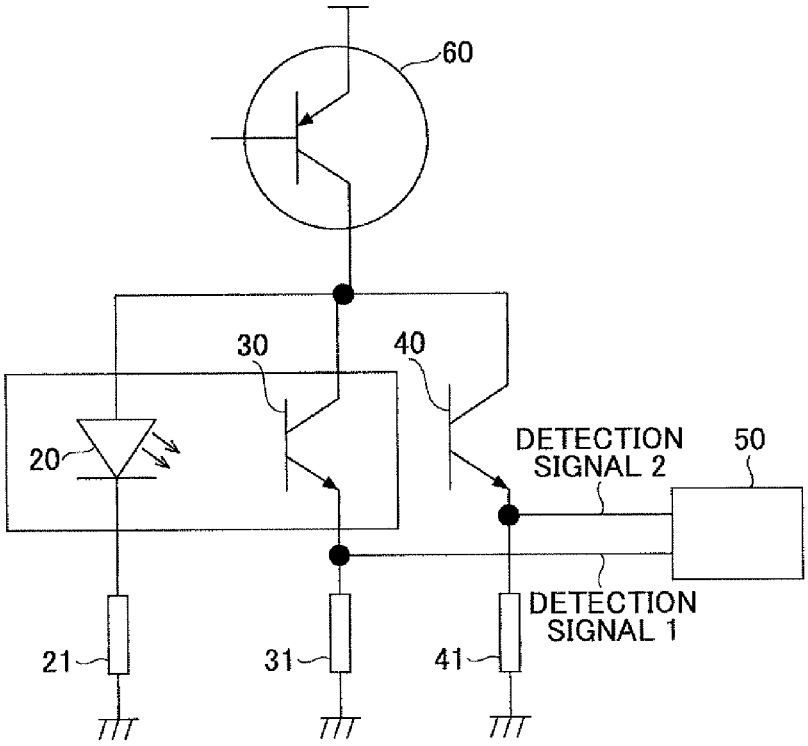
FIG. 2 illustrates a circuit diagram for detecting the recording paper in the printer apparatus of the first embodiment.

FIG. 2 is a circuit diagram of the printer apparatus of the first embodiment including the light emitting element 20, the first light receiving element 30 and the second light receiving element 40. Referring to FIG. 2 illustrating the first embodiment, a power switching circuit 60 including a transistor or the like is provided so as to be connected to the light emitting element 20, the first light receiving element 30 and the second light receiving element 40. The power switching circuit 60 is turned on when necessary. Then, electric power is supplied to the light emitting element 20, the first light receiving element 30 and the second light receiving element 40. A resistor 21 is connected to the light emitting element in series. A resistor 31 is connected to the first light receiving element 30 in series. A resistor 41 is connected to the second light receiving element 40 in series. An output from the first light receiving element 30 to the resistor 31 is input into the control circuit 50 as a detection signal 1. An output from the second light receiving element 40 to the resistor 41 is input into the control circuit 50 as a detection signal 2.

Referring to FIG. 2, when there is no recording paper between the light emitting element 20 and the second light receiving element 40, the detection signal 1 may become Low (L) by being detected (binarized) by the control circuit 50 and the second detection signal 2 may become High (H) by being detected (binarized) by the control circuit 50. Meanwhile, when there is a recording paper between the light emitting element 20 and the second light receiving element 40, the detection signal 1 may become H and the second detection signal 2 may become L.

Alternatively, when there is no recording paper between the light emitting element 20 and the second light receiving element 40, the detection signal 1 may become H and the second detection signal 2 may become L. Meanwhile, when there is a recording paper between the light emitting element 20 and the second light receiving element 40, the detection signal 1 may become L and the second detection signal 2 may become H.

Within the first embodiment, when there is no recording paper between the light emitting element 20 and the second light receiving element 40, the detection signal 1 may become L and the second detection signal 2 may become H. On the contrary, when there is the recording paper 10 between the light emitting element 20 and the second light receiving element 40, the detection signal 1 may become H and the second detection signal 2 may become L. If H and L of the detection signals 1 and 2 are inverse, the first embodiment is similarly applicable.

Further, if the black mark is formed on the recording paper 10, the detection signal 1 is detected by the first light receiving element 30, as a value which is lower than a level lower than the level obtained when the light is reflected on a part of the recording paper other than a part where the black mark is formed or as L. Said differently, in a case where the recording paper 10 exists and the black mark does not exist, the detection signal 1 is detected by the control circuit 50 as H and the detection signal 2 is detected by the control circuit 50 as L. In a case where the recording paper 10 exists and the black mark exists, a value of the detection signal 1 is lower than a predetermined voltage, which is lower than a value of the detection signal 1 when the recording paper does not exist, and the detection signal 2 is detected by the control circuit 50 as L. As described, the black mark can be detected based on the detection signals 1 and 2. When the recording paper 10 is conveyed, the detection signal 1 may be detected by the control circuit 50 as a downward directing pulse which the pulse appears from the High level (H) to the Low level (L) in the downward direction as in the upper half and t2 of FIG. 15.

Existence of the opening portion of the recording paper 10 is detected as follows. If the detection signal 1 is H and the detection signal 2 is L, it is determined that the opening portion does not exist. If the detection signal 1 is L and the detection signal 2 is H, it is determined that the opening portion exists. While the recording paper 10 is conveyed, the detection signal 1 is detected as a downward directing L pulse and the detection signal 2 is detected as an upward directing H pulse. Here, the upward directing pulse is a pulse which appears from L to H in the upward direction as in the lower half and t2 of FIG. 15.

(Printer Apparatus)

Figure 3:
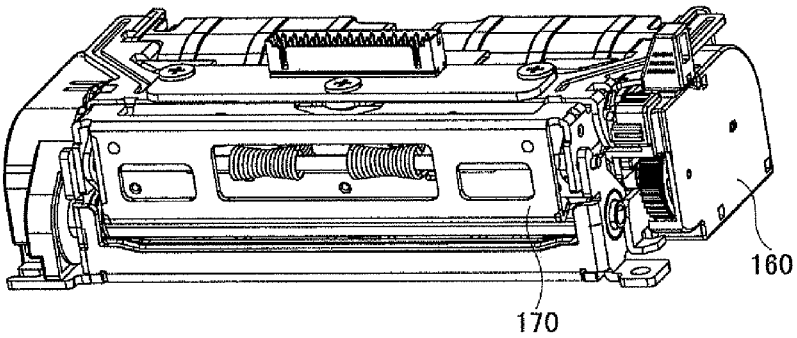
FIG. 3 is a perspective view of a printer apparatus of the first embodiment in a closed state.
Figure 4:
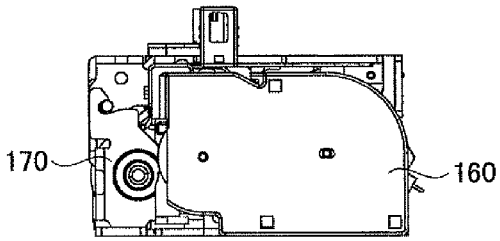
FIG. 4 is a side view of the printer apparatus of the first embodiment in the closed state.
Figure 5:
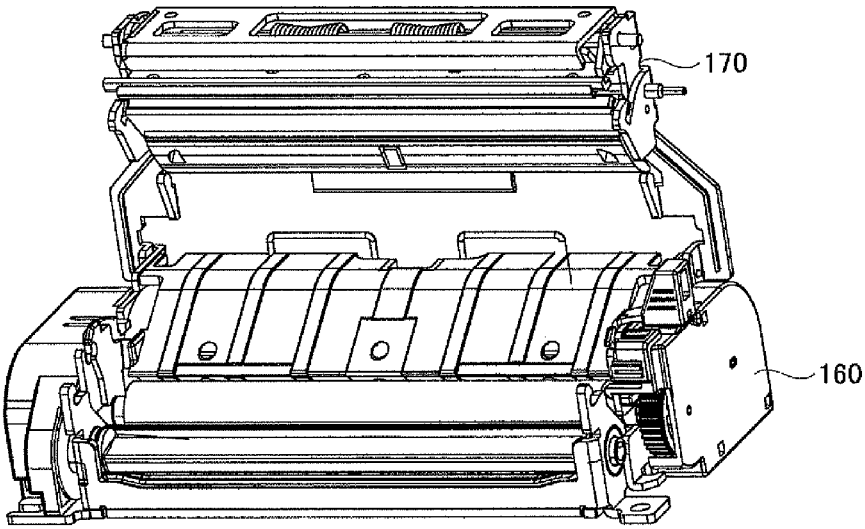
FIG. 5 is a perspective view of the printer apparatus of the first embodiment in an opened state.
Figure 6:
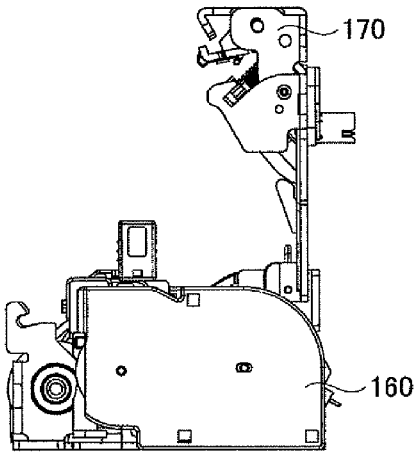
FIG. 6 is a side view of the printer apparatus of the first embodiment in the opened state.

The structure of the printer apparatus of the first embodiment is described next. Referring to FIG. 3 to FIG. 6, the printer apparatus of the first embodiment includes a recording paper conveying block 160 for holding a recording paper and conveying the recording paper and a head block 170 including a printer head. FIG. 3 and FIG. 5 are perspective views of the printer apparatus of the first embodiment. FIG. 4 and FIG. 6 illustrate side views of the printer apparatus of the first embodiment.

When characters, graphics or the like are printed in the recording paper in the printer apparatus of the first embodiment, the recording paper conveying block 160 and the head block 170 are closed as illustrated in FIG. 4. When maintenance work is done on the printer apparatus, the head block 170 is lifted upward from the recording paper conveying block 160 to open the printer apparatus.

The recording paper conveying block 160 includes a part for holding the recording paper and a motor for conveying the recording paper and so on. The head block 170 includes a thermal head as a printer head.

Figure 7:
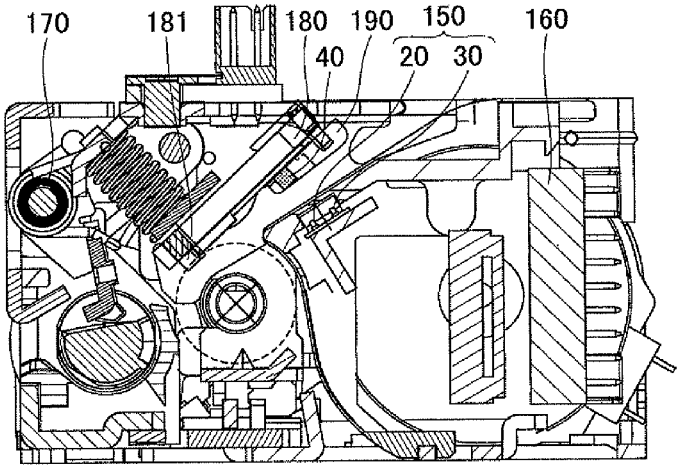
FIG. 7 illustrates a structure of the printer apparatus of the first embodiment.
Figure 8:
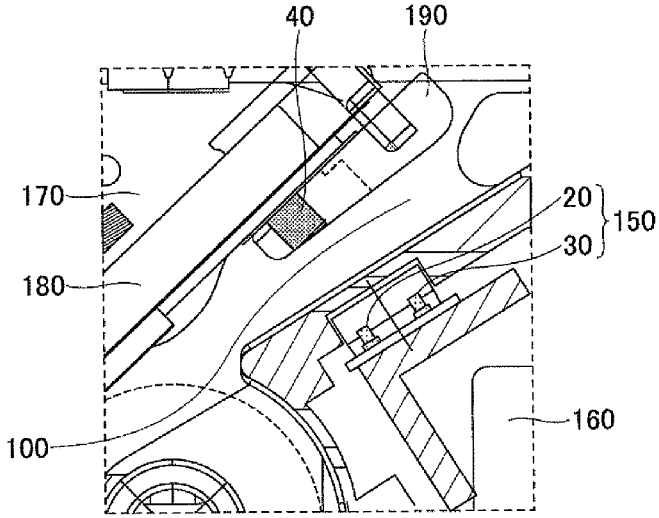
FIG. 8 is an enlarged view partly illustrating the printer apparatus of the first embodiment.

Referring to FIG. 7 and FIG. 8, the light emitting element 20 and the first light receiving element 30 are integrally formed so as to be installed in the recording paper conveying block 160. The second light receiving element 40 may be installed in the thermal head 180 being a printer head provided in the head block 170. By providing the second light receiving element 40 in the thermal head 180, it is possible to cause the detecting position of the recording paper to be as close as possible to the position of a printing part 181 where the characters, graphics or the like are printed in the recording paper to thereby accurately print the characters, graphics or the like on a predetermined position of the recording paper.

A cover 190 covers a part or all of a region other than a printing part 181 of the thermal head 180. The second light receiving element 40 may be provided in the thermal head 180 or the cover 190. Within the first embodiment illustrated in FIG. 7 and FIG. 8, the reflecting optical sensor 150 includes the light emitting element 20 and the first light receiving element 30 which are integrally formed. FIG. 8 is an enlarged view of an area where the light emitting element 20, the first light receiving element 30, and the second light receiving element 40 are installed. In FIGS. 8-14, a path for conveying the recording sheet (the recording paper) is provided between the light emitting element 20 and the second light receiving element 40 and between the first light receiving element 30 and the second light receiving element 40. The first light receiving element 30 is positioned on the same side as that of the light emitting element 20 relative to the path for conveying the recording paper. The second light receiving element 40 is positioned on a side opposite to the side of the light emitting element 20 relative to the path for conveying the recording paper.

Figure 9:
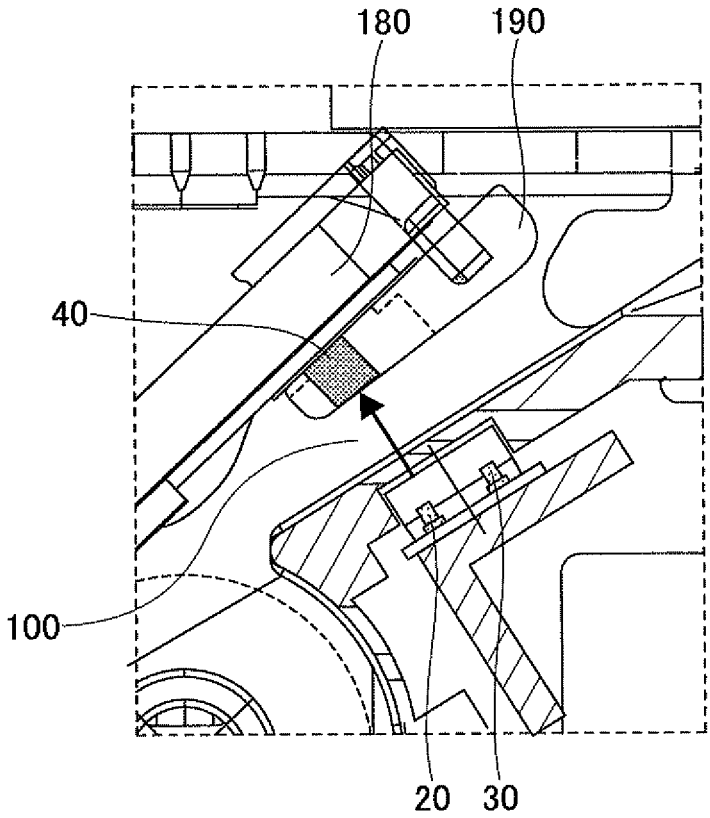
FIG. 9 illustrates the printer apparatus of the first embodiment.
Figure 10:
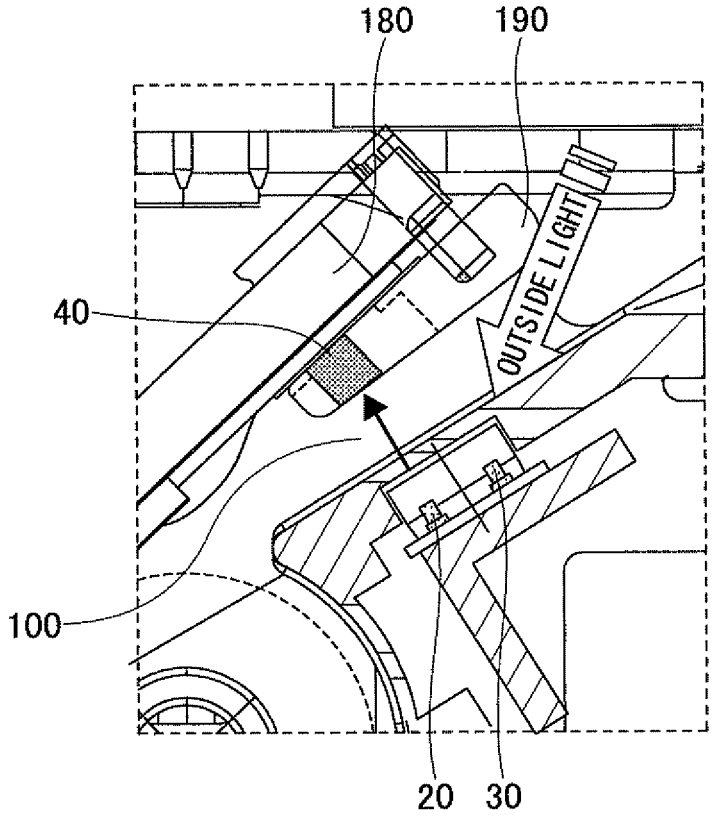
FIG. 10 illustrates the printer apparatus of the first embodiment.

Within the printer apparatus of the first embodiment illustrated in FIG. 9, when the recording paper 10 does not exist between the light emitting element 20 and the second light receiving element 40, the light emitted from the light emitting element 20 directly impinges on the second light receiving element 40 and does not impinge on the first light receiving element 30. In this case, referring to FIG. 10, outside light may impinge on the first light receiving element 30. In order to prevent erroneous determination that the recording paper 10 exists, if the light emitted from the light emitting element 20 is detected by the second light receiving element 40, information detected by the first light receiving element 30 may be ignored.

Figure 11:
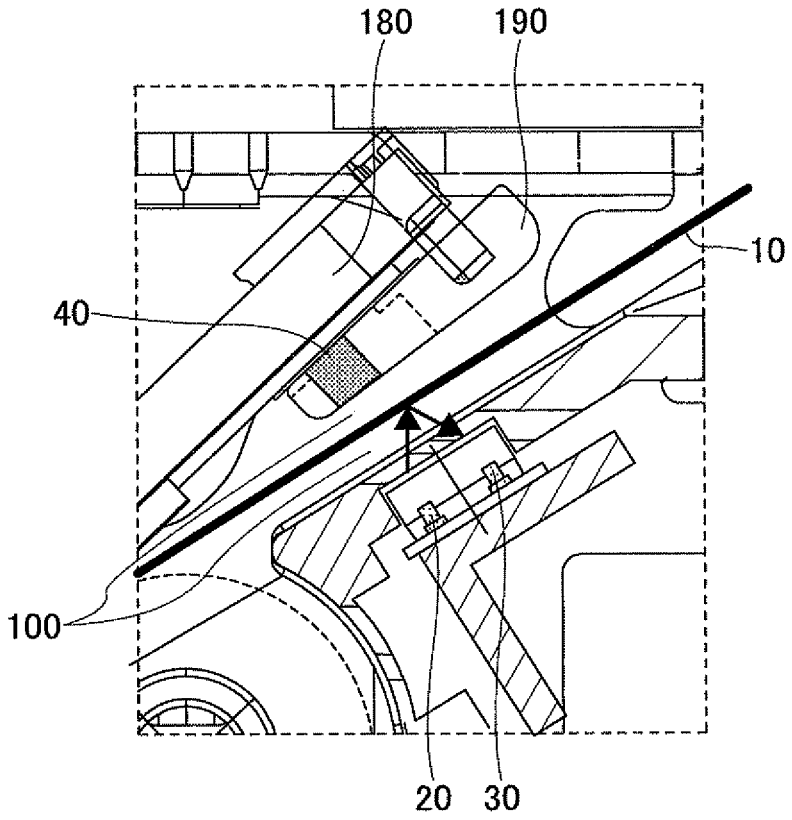
FIG. 11 illustrates the printer apparatus of the first embodiment.

Referring to FIG. 11, when the recording paper 10 exists between the light emitting element 20 and the second light receiving element 40, the light emitted from the light emitting element 20 is reflected by the recording paper 10 and impinges on the first light receiving element 30. In this case, the light emitted from the light emitting element 20 is shielded by the recording paper 10 and does not impinges on the second light receiving element 40. As described, it is possible to detect whether the recording paper 10 exists depending on whether the light is detected by the second light receiving element 40.

Figure 12:
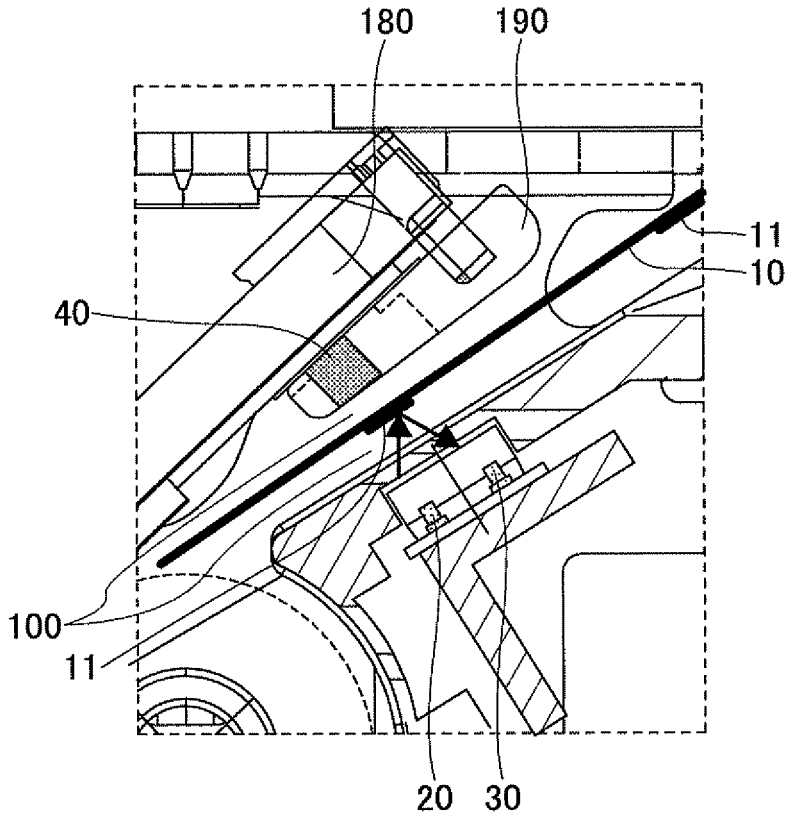
FIG. 12 illustrates the printer apparatus of the first embodiment.

Referring to FIG. 12, the reflection coefficient of the black mark 11 provided on the recording paper 10 is lower (for example, 7%) than the reflection coefficient of the recording paper. The light emitted from the light emitting element 20 may reflect from the black mark 11 provided on the recording paper 10. However, since the amount of the reflected light from the black mark 11 is small due to the low reflection coefficient of the black mark 11, the amount of the light impinging on the first light receiving element 30 may become small. Therefore, if light is not detected by the second light receiving element 40 and the light having a low light amount is detected by the first light receiving element, the black mark 11 may be determined to be detected. As described above, while the recording paper 10 is conveyed and detected by the first light receiving element 30, the downward pulse is detected by the control circuit 50.

Figure 13:
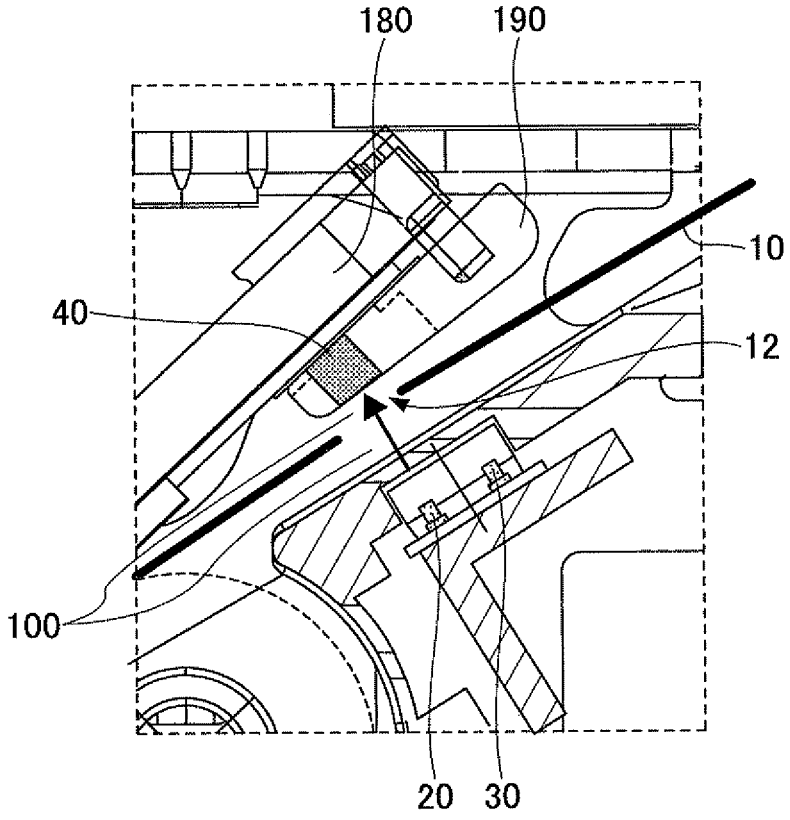
FIG. 13 illustrates the printer apparatus of the first embodiment.
Figure 14:
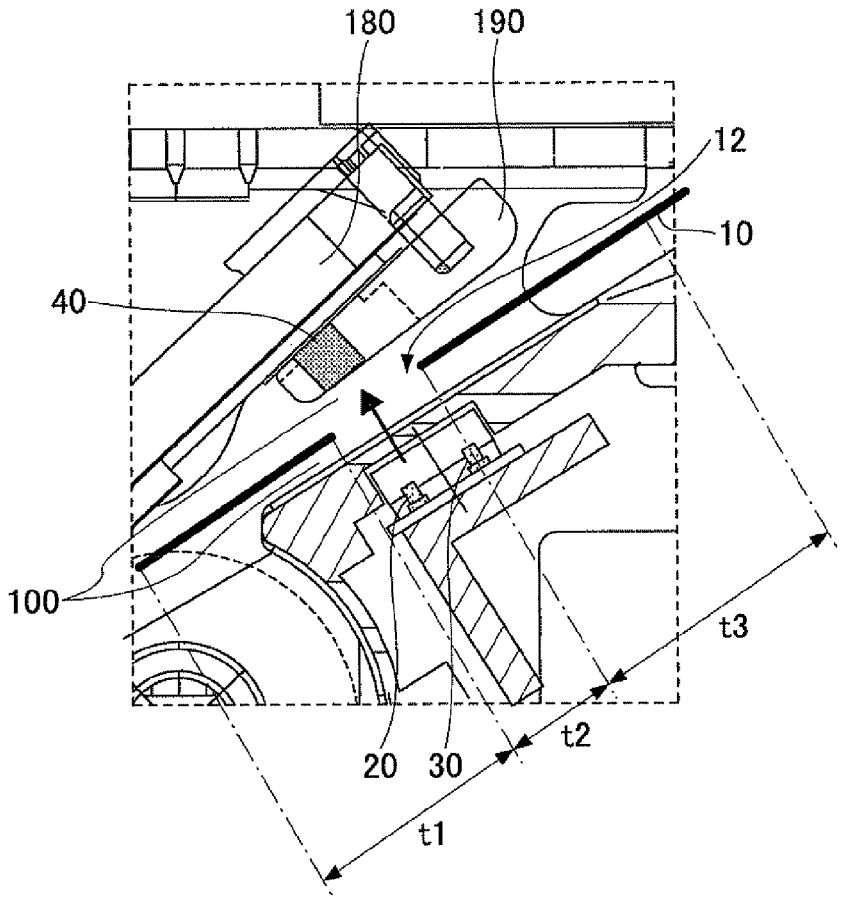
FIG. 14 illustrates the printer apparatus of the first embodiment.
Figure 15:
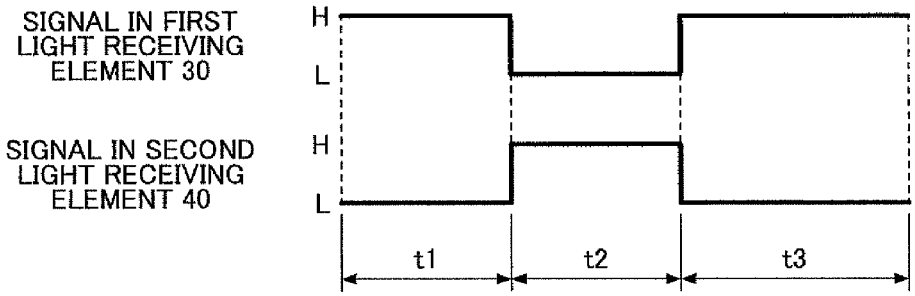
FIG. 15 is a time chart used for detecting a black mark.

Referring to FIG. 13, if an opening 12 is formed on the recording paper 10, light emitted from the light emitting element 20 directly impinges on the second light receiving element 40 but does not impinge on the first light receiving element 30. Meanwhile, since the recording paper 10 is normally conveyed, signals from the first and second light receiving elements 30 and 40 may be detected as pulse waveforms as illustrated in FIG. 15, where a time while the opening 12 of the recording paper 10 passes by the first or second light receiving element 30 or 40 is designated as t1, a time while a portion of the recording paper 10 positioned before the opening portion passes by the first or second light receiving element 30 or 40 is designated as t2, and a time while a portion of the recording paper 10 positioned after the opening portion passes by the first or second light receiving element 30 or 40 is designated as t3. Specifically, from the signal of the first light receiving element 30, the downward directing L pulse is detected between the times t1 and t3. From the signal of the second light receiving element 40, the upward directing H pulse is detected between the times t1 and t3. Therefore, by detecting the value of the signals from the first and second light receiving elements 30 and 40 in the time t2 when the downward directing L pulse and the upward directing H pulse are simultaneously observed, it is possible to detect whether the opening 12 formed in the recording paper 10 exists. There may be an optional case where an upward directing H level pulse in the time t2 may be obtained from the first light receiving element 30 between the times t1 and t3, and a downward directing L level pulse in the time t2 may be obtained from the second light receiving element 40 between the times t1 and t3. In this optional case also, it is possible to detect whether the opening 12 formed in the recording paper 10 exists.

When the light detected by the first light receiving element is a high level pulse and the light detected by the second light receiving element is a low level pulse, and then the light detected by the first light receiving element is a low level pulse and the light detected by the second light receiving element is a high level pulse, the control circuit determines that the opening portion is positioned between the light emitting element and the second light receiving element.

(Printer Head)

Figure 16:
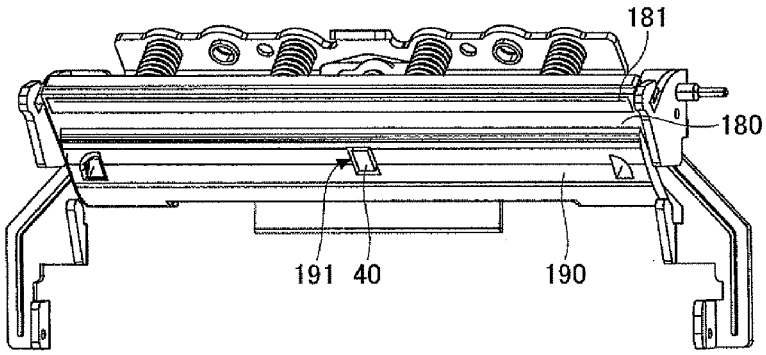
FIG. 16 is a perspective view of a printer head of the first embodiment.
Figure 17:
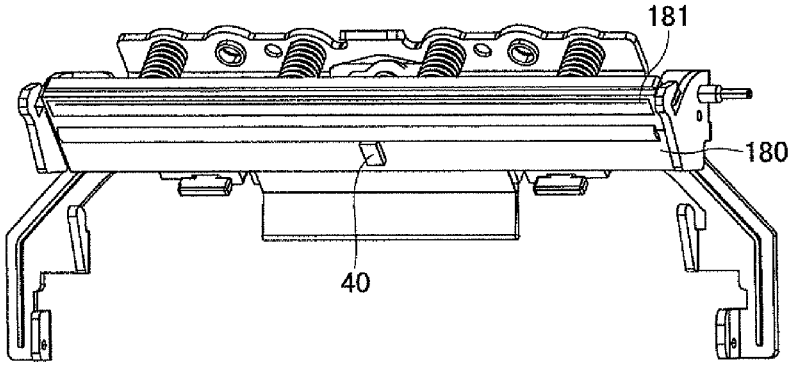
FIG. 17 is a perspective view of the printer head of the first embodiment.

Referring to FIG. 16 and FIG. 17, a printer head of the printer apparatus of the first embodiment is described. Within the first embodiment, the head block 170 includes a second light receiving element 40.

The thermal head 180 having the printing part 181 made of a heat generator or the like for printing the characters, graphics or the like on the recording paper 10 is provided in the head block 170. The second light receiving element 40 is provided in the thermal head 180. Although the second light receiving element 40 is installed in the thermal head 180, the second light receiving element 40 may be integrally formed with the thermal head 180.

In the printer apparatus of the first embodiment, the cover 190 for covering a part or all of an area other than the printing part 181 is attached to the thermal head on the upstream side of feeding the recording paper 10. The cover 190 has a hole 191 for introducing light into the second light receiving element 40. The shape of the hole 191 corresponds to the shape of the second light receiving element 40. By positioning the second light receiving element 40 in the vicinity of the printing part 181 of the thermal head 180, it is possible to accurately print characters, graphics or the like on a predetermined position of the recording paper 10 with a small amount of conveying the recording paper 10 by the thermal head 180 after detecting the recording paper 10 by the second light receiving element 40 or the like. For example, the cover 190 is made of a molded resin or the like. Referring to FIG. 16, the cover 190 is attached to the thermal head 180 of the first embodiment. Referring to FIG. 17, the cover 190 is detached from the thermal head 180.

Said differently, if a distance of the printing part 181 of the thermal head 180 from the position at which the recording paper 10 is detected is long, the amount of conveying the recording paper 10 increases after detecting the existence of the recording paper 10. Along with this, an error of conveying the recording paper 10 also increases. Then, a positional shift in printing characters, graphics or the like on the recording paper 10 becomes greater. However, within the first embodiment, a distance between the second light receiving element 40 and the printing part 181 of the thermal head 180 is short and the error of conveying the recording paper 10 becomes smaller. Therefore, it is possible to accurately print characters, graphics or the like on a predetermined position of the recording paper 10.

Further, by integrally forming the second light receiving element 40 and thermal head 180, the number of components of the printer apparatus can be reduced and a manufacturing process of the printer apparatus can be simplified. Thus, the printer apparatus can be manufactured at a low cost.

In the printer apparatus of the first embodiment, the second light receiving element 40 is provided in the thermal head 180, and the hole 191 is formed in the cover 190 attached to the thermal head 180 at the position where the second light receiving element is installed, thereby enabling the light to impinge on the second light receiving element 40 through the hole 191. The light emitting element 20 is provided at a position corresponding to the second light receiving element 40 so that the light emitted from the light emitting element 20 impinges on the second light receiving element 40 in a case where there is no recording paper.

Second Embodiment (Printer Apparatus)

Figure 18:
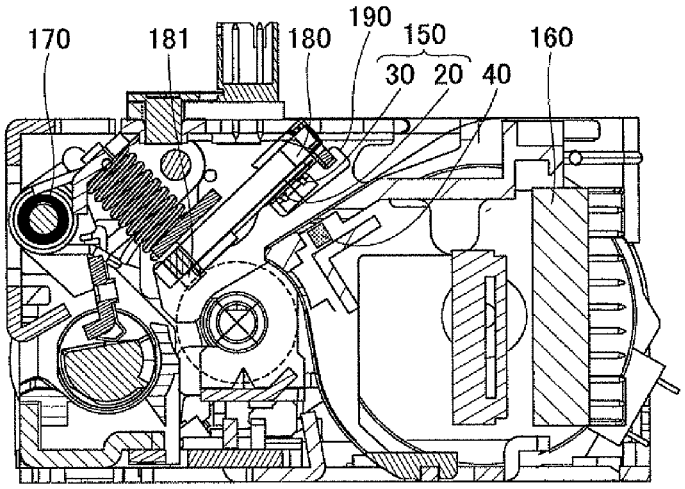
FIG. 18 illustrates a structure of the printer apparatus of a second embodiment.
Figure 19:
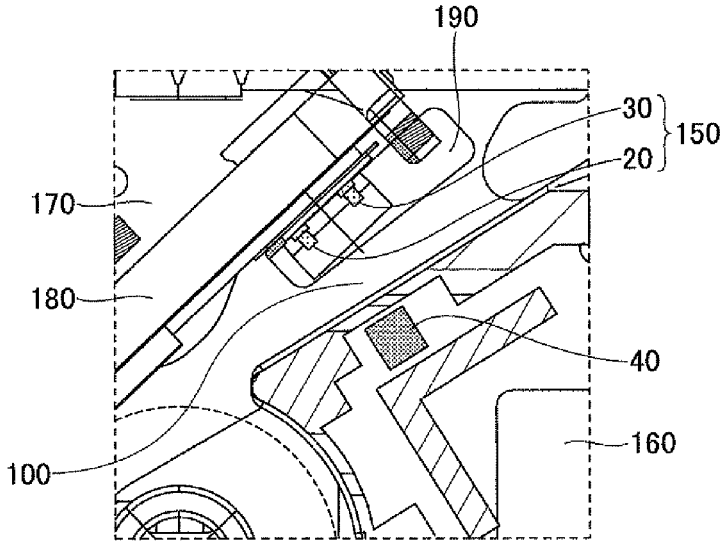
FIG. 19 is an enlarged view partly illustrating the printer apparatus of the second embodiment.

The structure of the printer apparatus of the second embodiment is described next. Referring to FIG. 18 and FIG. 19, a light emitting element 20 and a first light receiving element 30 are integrally formed to be a reflecting optical sensor 150. The reflecting optical sensor 150 is installed in a thermal head 180 being a printer head in a head block 170. The second light receiving element 40 is installed in a recording paper conveying block 160. By providing the light emitting element 20 and the first light receiving element 30 to the thermal head 180, it is possible to cause a detecting position of a recording paper to be as close as possible to the position of a printing part 181 where characters, graphics or the like are printed in the recording paper to thereby accurately print the characters, graphics or the like on a predetermined position of the recording paper. FIG. 19 is an enlarged view of an area where the light emitting element 20, the first light receiving element 30, and the second light receiving element 40 are installed. In FIG. 19, a path for conveying the recording sheet (the recording paper) is provided between the light emitting element 20 and the second light receiving element 40 and between the first light receiving element 30 and the second light receiving element 40. The first light receiving element 30 is positioned on the same side as that of the light emitting element 20 relative to the path for conveying the recording paper. The second light receiving element 40 is positioned on a side opposite to the side of the light emitting element 20 relative to the path for conveying the recording paper.

(Printer Head)

Figure 20:
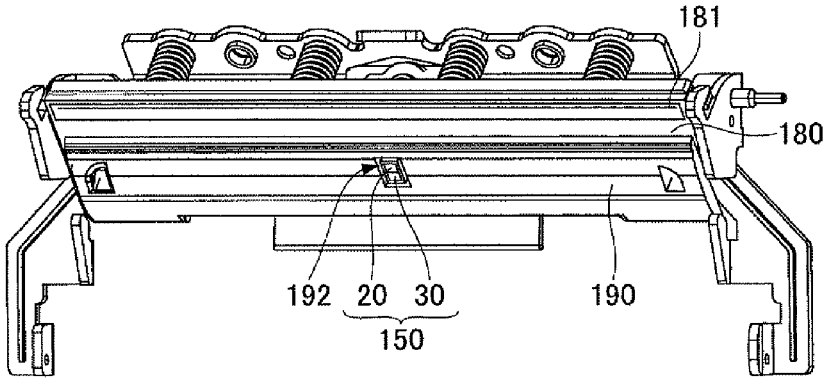
FIG. 20 is a perspective view of a printer head of the second embodiment.
Figure 21:
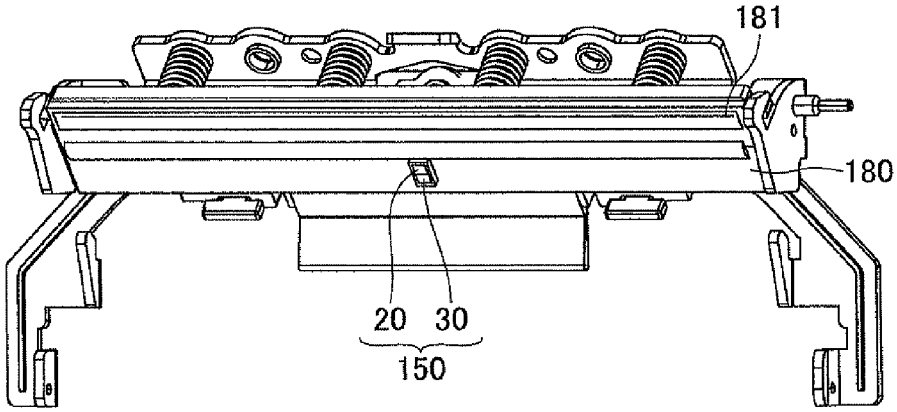
FIG. 21 is a perspective view of the printer head of the second embodiment.

Referring to FIG. 20 and FIG. 21, the printer head of the printer apparatus of the second embodiment is described. Within the second embodiment, the recording paper conveying block 160 includes the second light receiving element, and the head block 170 includes the reflecting optical sensor 150 formed by the light emitting element 20 and the first light receiving element 30.

The head block 170 includes the thermal head 180 being the printer head including the printing part 181 made of, for example, a heat generator for printing characters, graphics or the like on the recording paper. The reflecting optical sensor 150 including the light emitting element 20 and the first light receiving element 30 may be integrally formed with the thermal head 180.

In the printer apparatus of the second embodiment, a cover 190 for covering a part or all of an area other than a printing part 181 is attached to the thermal head 180 on the side of feeding the recording paper 10. The cover 190 has a hole 192 for enabling light to be emitted from the light emitting element 20 and to introduce the light into the second light receiving element 30. The shape of the hole 192 corresponds to the shape of the reflecting optical sensor 150 including the light emitting element 20 and the second light receiving element 30. By positioning the reflecting optical sensor 150 in the vicinity of the printing part 181 of the thermal head 180, it is possible to accurately print characters, graphics or the like on a predetermined position of the recording paper 10 with a small amount of conveying the recording paper 10 by the thermal head 180 after detecting the recording paper 10 by the second light receiving element 40 or the like. For example, the cover 190 is made of a molded resin or the like. Referring to FIG. 20, the cover 190 is attached to the thermal head 180 of the second embodiment. Referring to FIG. 21, the cover 190 is detached from the thermal head 180.

Said differently, if a distance of the printing part 181 of the thermal head 180 from the position at which the recording paper 10 is detected is long, the amount of conveying of the recording paper 10 increases. Along with this, an error of conveying the recording paper 10 also increases. Then, a positional shift in printing characters, graphics or the like on the recording paper 10 becomes greater. However, within the second embodiment, a distance between the first light receiving element 30 and the printing part 181 of the thermal head 180 is short and an error of conveying the recording paper 10 becomes smaller. Therefore, it is possible to accurately print characters, graphics or the like on a predetermined position of the recording paper 10.

Further, by integrally forming the reflecting optical sensor including the light emitting element 20 and the first light receiving element 30 with the thermal head 180, the number of components of the printer apparatus can be reduced, and the printer apparatus can be manufactured at a low cost.

Therefore, in the printer apparatus of the second embodiment, the reflecting optical sensor 150 including the light emitting element 20 and the first light receiving element 30 is provided in the thermal head 180. The cover 190 attached to the thermal head 180 has the hole 192 in the area where the reflecting optical sensor 150 including the light emitting element 20 and the first light receiving element 30 are formed. The light emitted from the light emitting element 20 passes through the hole 192 and impinges on the second light receiving element 40. In a case where the recording paper 10 does not exist, the second light receiving element 40 is provided at a position corresponding to the light emitting element 20 and the first light receiving element 30 so that the light emitted from the light emitting element 20 is received by the second light receiving element 40.

The other portions of the second embodiment are the same as those described in the first embodiment.

As described, by the printer apparatus and the printer head of the embodiments, the information of the position of the recording paper can be accurately detected and characters, graphics or the like can be accurately printed on the predetermined position of the recording paper. Further, this printer apparatus and this printer head can be manufactured at a low cost.

All examples and conditional language recited herein are intended for pedagogical purposes to aid the reader in understanding the invention and the concepts contributed by the inventor to furthering the art, and are to, be construed as being without limitation to such specifically recited examples and conditions, nor does the organization of such examples in the specification relate to a showing of superiority or inferiority of the invention. Although the embodiments of the present invention have been described in detail, it should be understood that the various changes, substitutions, and alterations could be made hereto without departing from the spirit and scope of the invention.

What is claimed is:

1. A printer apparatus comprising:

a recording sheet conveying block, the recording sheet conveying block includes a conveying element for conveying a recording sheet, a light emitting element configured to emit light, and a first light receiving element that is configured to receive the light; and a head block that is movable relative to the recording sheet conveying block between a closed state and an opened state, a gap between the recording sheet conveying block and the head block when the head block is in the closed state forms a path for conveying the recording sheet, the head block includes a printer head configured to print characters on the recording sheet, and a second light receiving element provided at a position facing the light emitting element across the path and configured to receive the light; and a control circuit connected to and controlling an operation of the light emitting element, the first light receiving element, and the second light receiving element, wherein the control circuit determines, when the light is detected by the second light receiving element, that the recording sheet does not exist in the path, and wherein the control circuit determines, when the light is not detected by the second light receiving element and is detected by the first light receiving element, that the recording sheet exists in the path.

2. The printer apparatus according to claim 1, wherein the printer head is a thermal head, and the second light receiving element is provided in the thermal head.

3. The printer apparatus according to claim 1, wherein the light emitting element and the first light receiving element are integrally formed.

4. The printer apparatus according to claim 1, wherein the control circuit determines, when the light is not detected by the second light receiving element and the light is not detected by the first light receiving element, or when the light is not detected by the second light receiving element and the light detected by the first light receiving element has a predetermined value or smaller, that a mark for detecting a position of the recording sheet exists on the recording sheet.

5. The printer apparatus according to claim 1, wherein the control circuit determines that an opening portion opened in and penetrating through the recording sheet is positioned between the light emitting element and the second light receiving element when the first light receiving element detects low-level light and the second light receiving element detects high-level light, and then the first light receiving element detects high-level light and the second light receiving element detects low-level light.

6. A printer apparatus comprising:

a recording sheet conveying block;

a head block that is movable relative to a recording sheet conveying block between a closed state and an open state, a gap between the recording sheet conveying block and the head block when the head block is in the closed state forms a path for conveying the recording sheet, the head block includes a printer head configured to print characters on the recording sheet, a light emitting element configured to emit light, and a first light receiving element that is configured to receive the light; and a control circuit connected to and controlling an operation of the light emitting element, the first light receiving element, and a second light receiving element, wherein the recording sheet conveying block includes a conveying element for conveying the recording sheet, and the second light receiving element provided at a position facing the light emitting element across the path and configured to receive the light, wherein the control circuit determines, when the light is detected by the second light receiving element, that the recording sheet does not exist in the path, and wherein the control circuit determines, when the light is not detected by the second light receiving element and is detected by the first light receiving element, that the recording sheet exists in the path.

7. The printer apparatus according to claim 6, wherein the printer head is a thermal head, and the light emitting element and the first light receiving element are provided in the thermal head.

* * * * *